US008851918B2

(12) United States Patent
Yoshisuji et al.

(10) Patent No.: US 8,851,918 B2
(45) Date of Patent: Oct. 7, 2014

(54) ELECTRICAL CONNECTOR WITH AUTOMATIC LOCK MEMBER

(75) Inventors: Takashi Yoshisuji, Machida (JP); Miyoshi Takagi, Machida (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 87 days.

(21) Appl. No.: 13/595,147

(22) Filed: Aug. 27, 2012

(65) Prior Publication Data

US 2014/0057478 A1 Feb. 27, 2014

(51) Int. Cl.
*H01R 13/627* (2006.01)
*H01R 13/639* (2006.01)

(52) U.S. Cl.
CPC ..... *H01R 13/639* (2013.01)
USPC ..... 439/350; 439/260; 439/495

(58) Field of Classification Search
USPC ..... 439/350, 329, 260, 495
See application file for complete search history.

(56) References Cited

U.S. PATENT DOCUMENTS

| | | | | |
|---|---|---|---|---|
| 7,850,473 | B1 * | 12/2010 | Ozeki | 439/260 |
| 8,002,567 | B2 * | 8/2011 | Hara | 439/329 |
| 8,398,417 | B2 * | 3/2013 | Ozeki | 439/260 |
| 2011/0136365 | A1 * | 6/2011 | Hara | 439/329 |
| 2012/0064749 | A1 * | 3/2012 | Hashimoto | 439/329 |
| 2012/0214329 | A1 * | 8/2012 | Ishimaru | 439/350 |
| 2012/0238125 | A1 * | 9/2012 | Yoshisuji et al. | 439/350 |

FOREIGN PATENT DOCUMENTS

| | | | |
|---|---|---|---|
| JP | 2003-100370 | | 4/2003 |
| JP | 2009-231069 | | 10/2009 |
| JP | 2011-40246 | | 2/2011 |
| JP | 2013125668 A | * | 6/2013 |

OTHER PUBLICATIONS

U.S. Appl. No. 29/447,042, filed Feb. 28, 2013, Yoshisuji.
U.S. Appl. No. 29/454,279, filed May 8, 2013, Yoshisuji.
U.S. Appl. No. 29/454,268, filed May 8, 2013, Yoshisuji.
U.S. Appl. No. 29/457,234, filed Jun. 7, 2013, Yoshisuji.
U.S. Appl. No. 29/457,252, filed Jun. 7, 2013, Yoshisuji.
U.S. Appl. No. 29/402,240, filed Sep. 22. 2011, Yoshisuji.
U.S. Appl. No. 29/402,237, filed Sep. 22, 2011, Yoshisuji.
U.S. Appl. No. 29/402,872, filed Sep. 28, 2011, Yoshisuji.

* cited by examiner

*Primary Examiner* — Hae Moon Hyeon
(74) *Attorney, Agent, or Firm* — Oblon, Spivak, McClelland, Maier & Neustadt, L.L.P.

(57) ABSTRACT

The operability and usage durability of a lock cancellation operating part (12*e*) can be improved with a simple configuration. A latch lock part (12*a*) and a lock cancellation operating part (12*e*) are integrally provided to an elastically-displaceable lock arm member (12*g*), which is integrally extending like a cantilever from a board connecting part (12*c*) solder-joined with a main wiring board. The board connecting part (12*c*), the latch lock part (12*a*), and the lock cancellation operating part (12*e*) are integrally provided with the lock arm member (12*g*) so that a retaining action and a cancelling action of the inserted signal transmission medium (F) is carried out by operation of a single member.

3 Claims, 16 Drawing Sheets

ELECTRICAL CONNECTOR WITH AUTOMATIC LOCK MEMBER

BACKGROUND OF THE INVENTION

1. Field of the Invention

The present invention relates to an electrical connector configured to retain a signal transmission medium by elastic engagement force of a lock member by inserting a terminal part of the signal transmission medium to a predetermined position in an insulating housing.

2. Description of Related Art

Generally, in various electrical devices, etc., various electrical connectors are widely used as means for electrically connecting various signal transmission media such as flexible printed circuits (FPC) and flexible flat cables (FFC). For example, in an electrical connector mounted and used on a printed wiring board like below-described Patent Literature 1, a signal transmission medium composed of, for example, FPC or FFC is inserted from a front-end-side opening of an insulating housing (insulator) into the interior thereof, and an actuator (connection operating means) is then turned by operating force of an operator so as to be pushed down toward a connection working position in the front side or the rear side of the connector. As a result, part of a lock member is put into an engaging part provided at a terminal part of the signal transmission medium to achieve an engaged state, and the terminal part of the signal transmission medium is configured to be retained in an approximately immobile state by the lock member.

In this manner, an electrical connector having an actuator is configured to operate engagement/detachment of a lock member by carrying out operation to turn the actuator between a disconnecting position and a connection working position, wherein work efficiency is sometimes a problem since the actuator has to be operated separately from the operation to insert the signal transmission medium (for example, FPC, FFC). Therefore, for example, like below-described Patent Literature 2 and 3, an electrical connector provided with a so-called one-action automatic locking mechanism configured so that part of a lock member is elastically displaced so as to be placed over a signal transmission medium inserted into an insulating housing and that the part of the lock member is then put into an engaging part of the signal transmission medium to carry out engagement has been conventionally developed. When an electrical connector provided with such a one-action automatic locking mechanism is used, a signal transmission medium is retained in an approximately immobile state only by inserting the signal transmission medium to a predetermined position in the electrical connector, and work efficiency is improved.

However, the one-action automatic locking mechanism employed in conventional electrical connectors has an advantage that locking is carried out only by inserting a signal transmission medium (for example, FPC, FFC) into the electrical connector as described above; however, the configuration of a lock cancellation operating part for cancelling an engaged state of a latch lock part tends to be complex, the cancelling operation takes labor, and a problem may be caused in usage durability.

CITATION LIST

Patent Literature

Patent Literature 1: Japanese Patent Application Laid-Open No. 2003-100370

Patent Literature 2: Japanese Patent Application Laid-Open No. 2009-231069

Patent Literature 3: Japanese Patent Application Laid-Open No. 2011-040246

SUMMARY OF THE INVENTION

Therefore, it is an object of the present invention to provide an electrical connector capable of improving operability and usage durability of a lock cancellation operating part with a simple configuration.

Means for Solving the Problems

In order to achieve the above described object, the present invention employs a configuration in which: an electrical connector configured to be mounted on a wiring board, the wiring board solder-joined with a board connecting part, the electrical connector having a latch lock part engaged with a terminal part of a signal transmission medium inserted in an insulating housing to retain the signal transmission medium in an approximately immobile state, the electrical connector configured so that the engaged state of the latch lock part can be cancelled by operating a lock cancellation operating part; the electrical connector having a lock arm member integrally extending like a cantilever from the board connecting part and disposed so as to be elastically displaceable; and the latch lock part and the lock cancellation operating part are elastically displaceably provided integrally at an intermediate position and a free-end position in an extending direction of the lock arm member.

According to the present invention having such a configuration, the board connecting part, the latch lock part, and the lock cancellation operating part are integrally provided with the lock arm member. Therefore, the retaining action and the cancelling action of the inserted signal transmission medium are carried out by operation of a single member, the structure and operation of the cancellation operating part are simplified, and usage durability is also improved.

The lock arm member in the present invention is desired to be bent-formed so as to be folded back between the board connecting part and the latch lock part.

According to the invention having such a configuration, even when the electrical connector is downsized, a sufficient length of the lock arm member can be ensured in small space, and the operating force of the lock cancellation operating part provided at the free-end position can be correspondingly suppressed to be small. Also, when the latch lock part is disposed in the bent-part side, larger retaining force can be ensured for the latch lock part.

Moreover, in the present invention, it is desired that electrically-conductive contact for signal transmission in contact with the terminal part of the signal transmission medium be attached to the insulating housing; and a board connecting part provided in the electrically-conductive contact and the board connecting part provided in the lock arm member be disposed in mutually-opposed both edge parts of the insulating housing.

According to the present invention having such a configuration, by virtue of the board connecting parts disposed at mutually-opposed both edge parts, the entire electrical connector is fixed in a state that is balanced from both sides, and firm retainability can be obtained with respect to external force caused by, for example, insertion of the signal transmission medium.

Moreover, in the present invention, it is desired that the lock cancellation operating part be disposed at each of longitudinal-direction both-end parts of the insulating housing; and cut-away parts for exposing the lock cancellation operating parts to outside be provided at the longitudinal-direction both-end parts of the insulating housing.

According to the present invention having such a configuration, if insertion of the signal transmission medium is not enough, the lock cancellation operating part, which is exposed to outside from the cut-away part of the insulating housing when insertion of the signal transmission medium is carried out well, is maintained in the state in which the operating part is buried inside of the insulating housing. Therefore, whether the insertion operation of the signal transmission medium is good or not can be easily determined.

As described above, in the electrical connector according to the present invention, the latch lock part and the lock cancellation operating part are integrally provided to the elastically-displaceable lock arm member integrally extending like a cantilever from the board connecting part solder-joined with the wiring board. The board connecting part, the latch lock part, and the lock cancellation operating part are integrally provided to the lock arm member so that the retaining action and cancelling action of the inserted signal transmission medium are carried out by operation of a single member. Therefore, operability and usage durability of the lock cancellation operating part can be improved with a simple configuration, and reliability of the electrical connector can be significantly improved at low cost.

DETAILED DESCRIPTION OF THE PREFERRED EMBODIMENTS

Hereinafter, embodiments in which the present invention is applied to an electrical connector mounted and used on a wiring board in order to establish electrical connection of a signal transmission medium composed of, for example, a flexible printed circuit (FPC) or a flexible flat cable (FFC) will be explained in detail based on drawings.

[About Overall Configuration of Electrical Connector According to First Embodiment]

Figure 5:
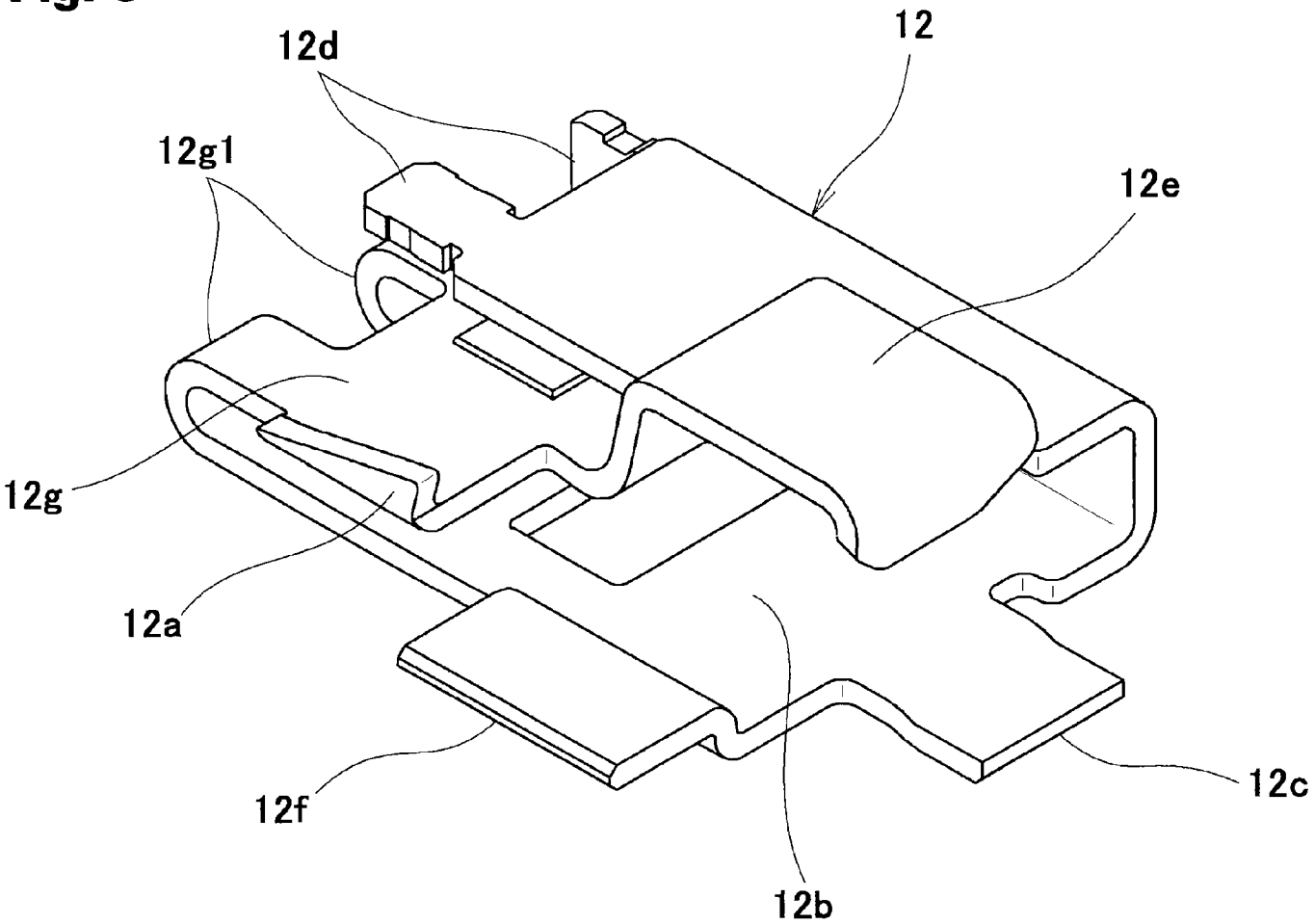
FIG. 5 is an external perspective explanatory view showing, from a planar side, a lock member used in the electrical connector shown in FIG. 1 to FIG. 4.
Figure 6:
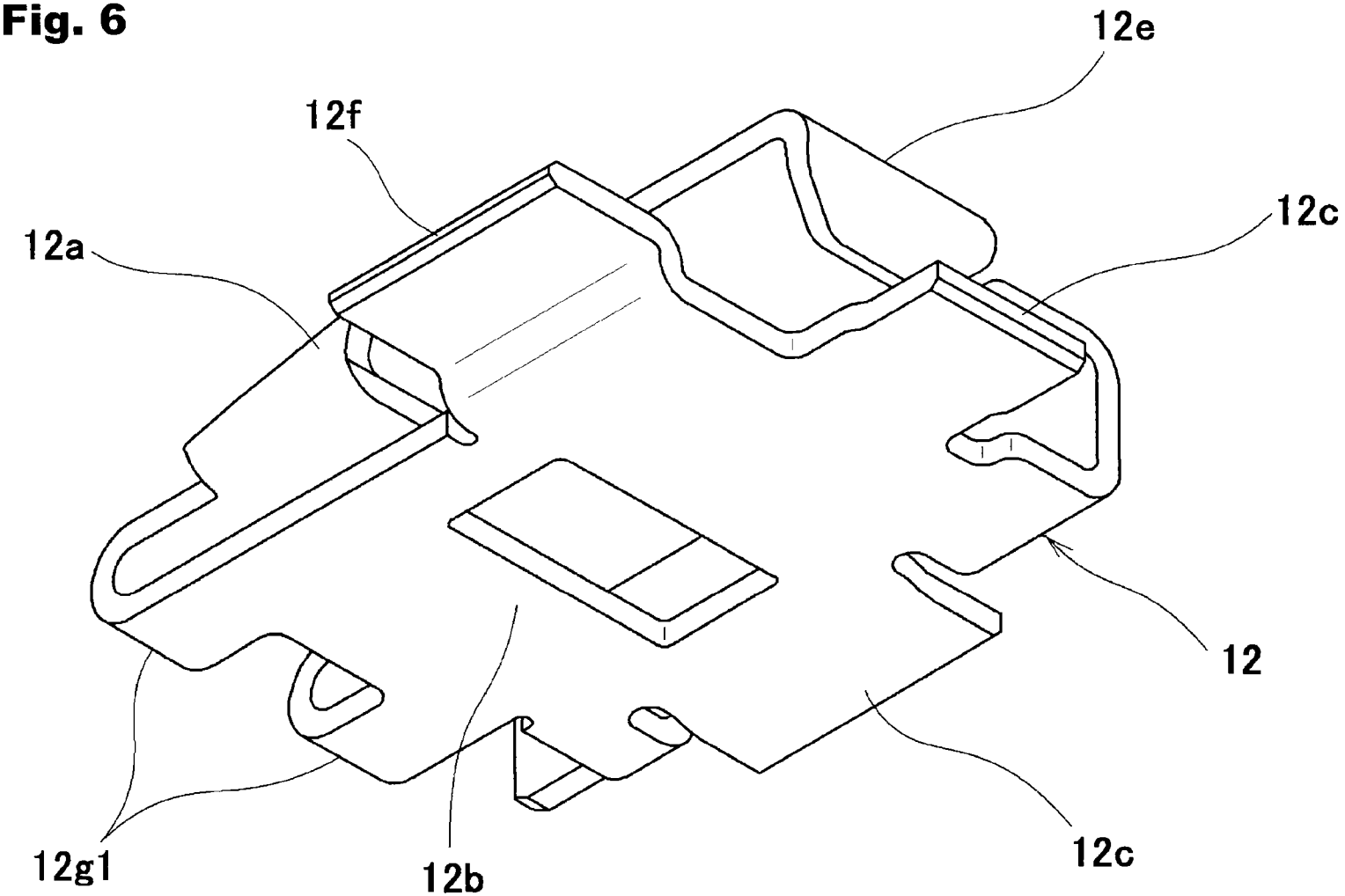
FIG. 6 is an external perspective explanatory view showing, from a bottom surface side, the lock member shown in FIG. 5.
Figure 7:
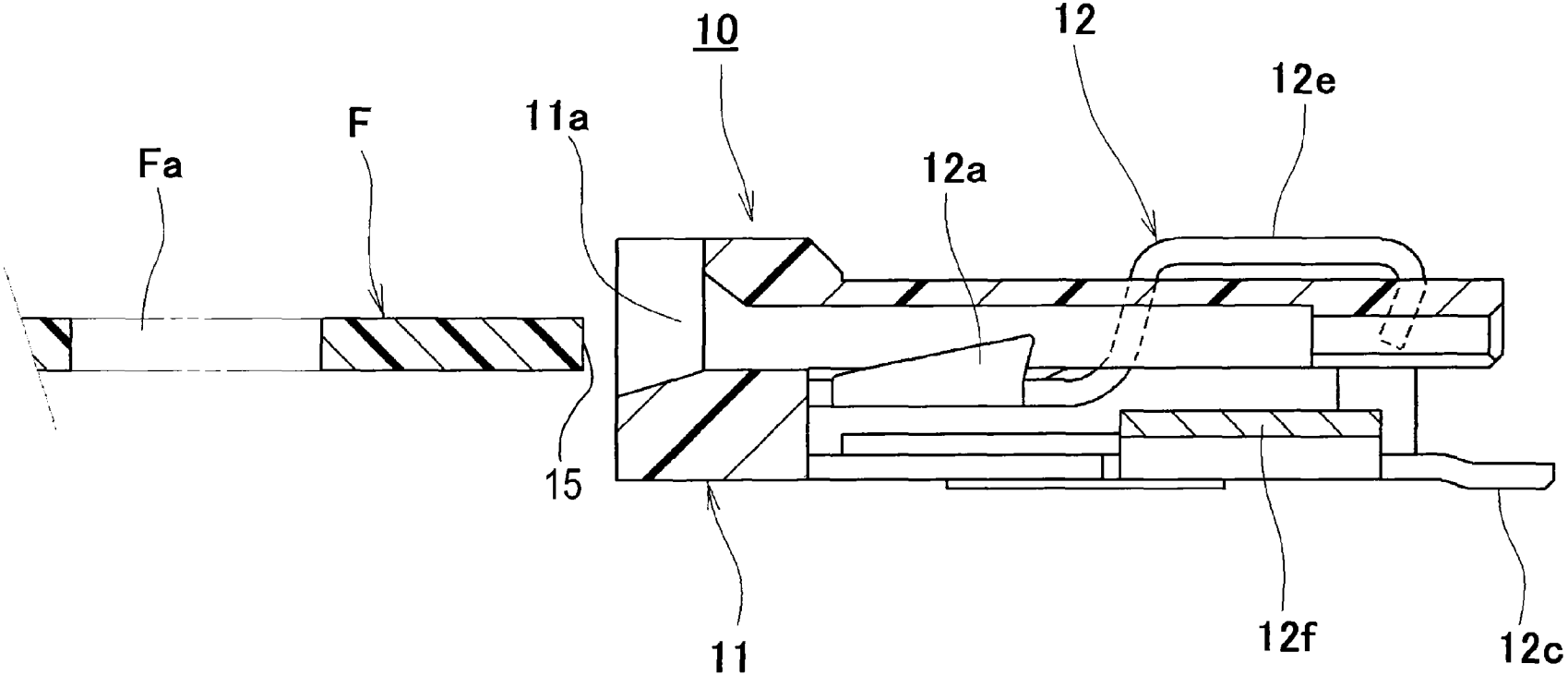
FIG. 7 is a transverse cross-sectional explanatory view of a connector-longitudinal-direction both-end part showing a state immediately before a signal transmission medium is inserted to the electrical connector shown in FIG. 1 to FIG. 4.

An electrical connector 10 according to a first embodiment of the present invention shown in FIG. 1 to FIG. 9 is an electrical connector provided with a one-action automatic locking mechanism of a so-called non-zif (NON-ZIF) type, which is configured so that the signal transmission medium F is automatically locked when a terminal part 15, best shown in FIG. 7, of the above described signal transmission medium (for example, FPC or FFC) is inserted to a predetermined position in an insulating housing 11 through a medium insertion opening 11*a* provided at a front-end edge part (left-end edge part of FIG. 4) of the insulating housing 11.

[About Insulating Housing]

In this case, the insulating housing 11 is formed of a hollow frame-like insulating member, which is extended to be thin and narrow. The longitudinal width direction of the insulating housing 11 will be hereinafter referred to as "connector longitudinal direction", and the direction for inserting or detaching the terminal part 15 of the signal transmission medium (for example, FPC or FFC) F will be referred to as "connector front-rear direction".

The medium insertion opening 11*a*, into which the terminal part of the signal transmission medium F composed of, for example, a flexible printed circuit (FPC) or a flexible flat cable (FFC) as described above is inserted, is provided at a front-end edge part (left-end edge part in FIG. 4) of the insulating housing 11 so as to be thin and long along the connector longitudinal direction. Lock members 12, which will be described later, are attached to both-side outer parts of the medium insertion opening 11*a* which are connector-longitudinal-direction both-end parts of the insulating housing 11. Furthermore, at a rear-end-side part (right-end edge part in FIG. 4) of the insulating housing 11, in other words, at a part that is in the side opposite to the above described medium insertion opening 11*a* in the connector front-rear direction, a part attachment opening 11*b* for attaching, for example, electrically-conductive contacts 13 are provided so as to be thin and long also along the connector longitudinal direction.

[About Electrically-Conductive Contact]

The electrically-conductive contacts 13 are formed of thin-plate-like metal members forming appropriate shapes. The plurality of electrically-conductive contacts 13 are inserted from the part attachment opening 11*b* in the rear-end side of the insulating housing 11 toward the front side (left side in FIG. 4) and are disposed like multiple electrodes with appropriate intervals therebetween in the connector longitudinal direction in the insulating housing 11. Each of the electrically-conductive contacts 13 is used for signal transmission or for ground connection in a state in which the electrically-conductive contact is mounted by solder joining on an electrically conductive path formed on a main printed wiring board (illustration omitted).

In other words, the disposed positions of the electrically-conductive contacts 13 attached in the insulating housing 11 in the above described manner are set to correspond to a wiring pattern provided on the signal transmission medium (for example, FPC or FFC) F, which is inserted to the inner side of the insulating housing 11 through the medium insertion opening 11*a*. The wiring pattern provided on the signal transmission medium F is signal-transmitting electrically-conductive paths (signal-line pads) or shielding electrically-conductive paths (shield line pads) disposed at appropriate pitch intervals.

The configuration of each of the electrically-conductive contacts 13 will be explained in detail. The electrically-conductive contact 13 is formed so as to extend along the connector front-rear direction, which is the inserting/removing direction of the signal transmission medium F (left-right direction in FIG. 4). A part projecting from a connector rear end part of the insulating housing 11 toward the rear side is formed as a board connecting part 13*a* solder-joined with the signal-transmitting electrically-conductive path (signal-line pad) formed on the main printed wiring board (illustration omitted). The board connecting part 13*a* is continued to a flexible arm part 13*b*, which is composed of a thin and long beam member extending toward the front side from the board connecting part 13*a* via an upper step part.

More specifically, the flexible arm part 13*b* is formed to be bent so as to rise approximately at a right angle at the part continued to the above described board connecting part 13*a*, is further bent at the rising end approximately at a right angle toward the front side, and is extending so as to form a cantilever shape along an inner wall surface of a ceiling plate of the insulating housing 11 in the upper side of the drawing. In this manner, the flexible arm part 13*b* provided in the electrically-conductive contact 13 is configured to be swung about the part continued to the board connecting part 13*a* or the vicinity thereof in the top-bottom direction of the paper surface of FIG. 4.

At the front-end side extending part (left-end-side part in FIG. 4) of the flexible arm part 13*b*, a terminal contact projecting part 13*c* is provided so as to form a shape projecting downward in the drawing to correspond to the signal-transmitting electrically-conductive path or the shield electrically-conductive path (wiring pattern) formed on the signal transmission medium (for example, FPC or FFC) F. More specifically, the terminal contact projecting part 13*c* provided in the electrically-conductive contact 13 is configured to have an arrangement relation that it is placed over the wiring pattern provided on the signal transmission medium F when the signal transmission medium F is inserted into the insulating housing 11 in the above described manner; and, when the signal transmission medium F is inserted to a predetermined final position, the terminal contact projecting part 13*c* is configured to be brought into contact therewith with pressure and maintained in an electrically connected state by the elastic force of the flexible arm part 13*b*.

[About One-Action Automatic Locking Mechanism]

Figure 1:
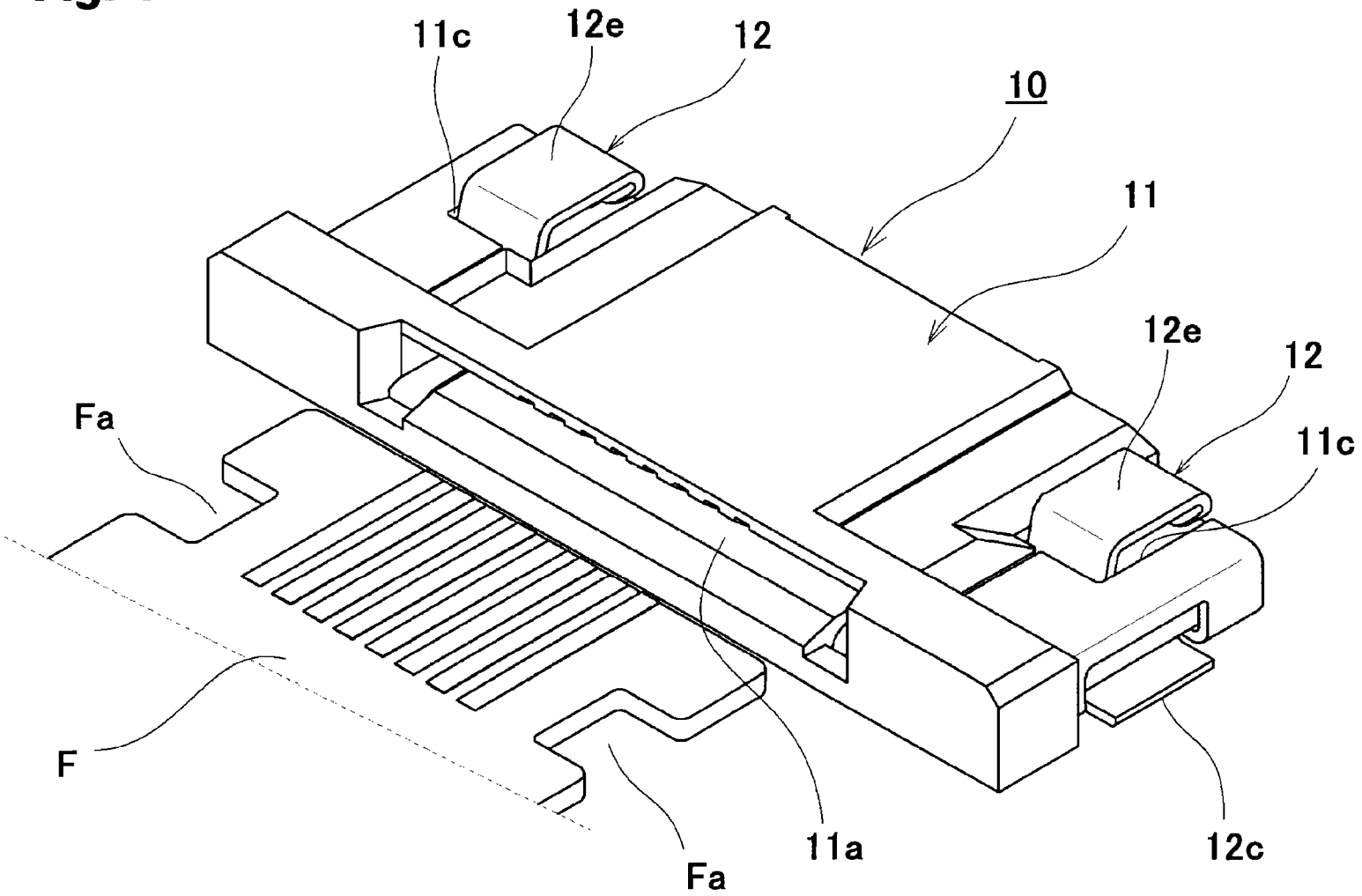
FIG. 1 is an external perspective explanatory view showing an electrical connector according to a first embodiment of the present invention.
Figure 2:
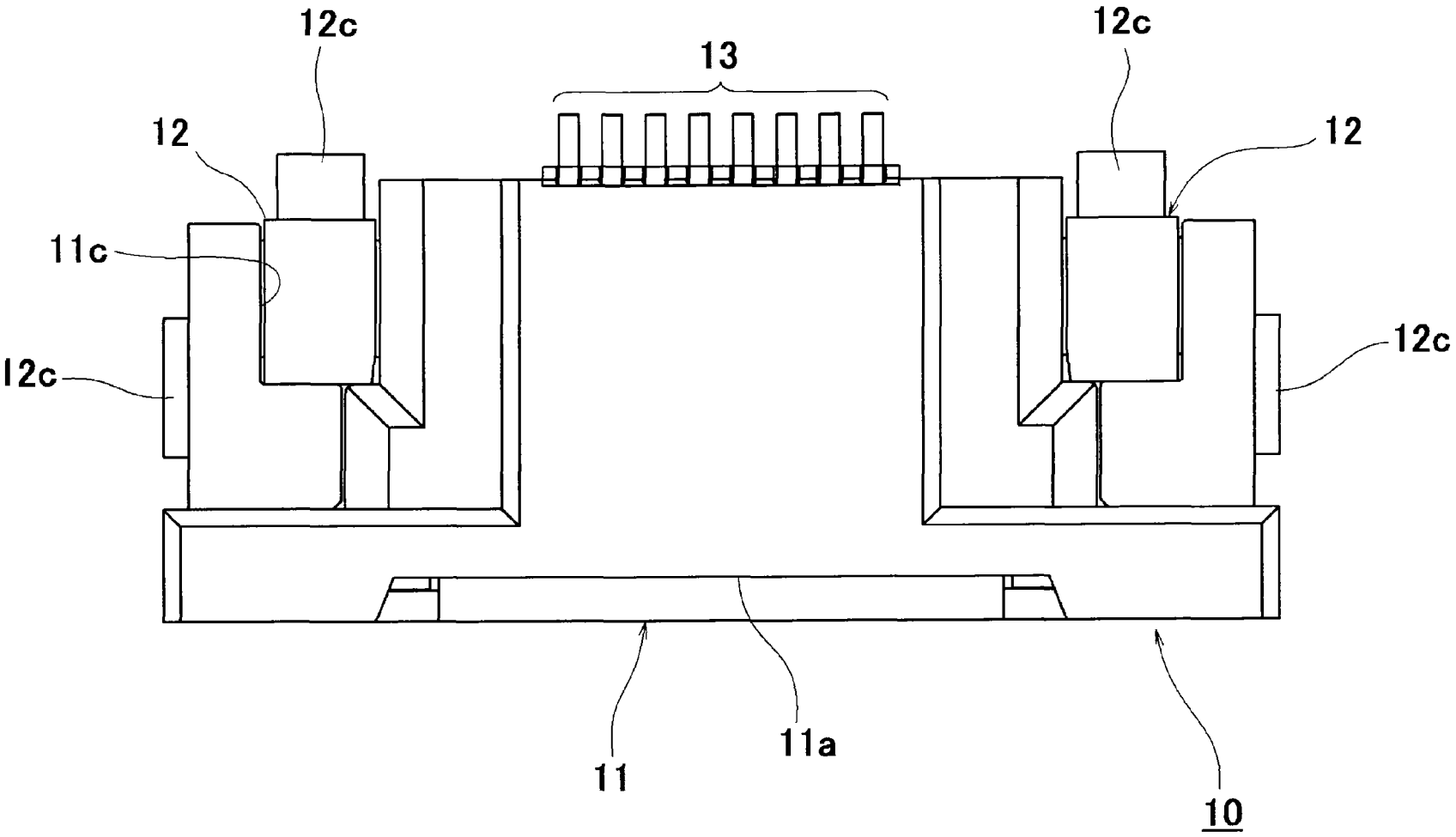
FIG. 2 is a plan explanatory view of the electrical connector shown in FIG. 1.
Figure 3:
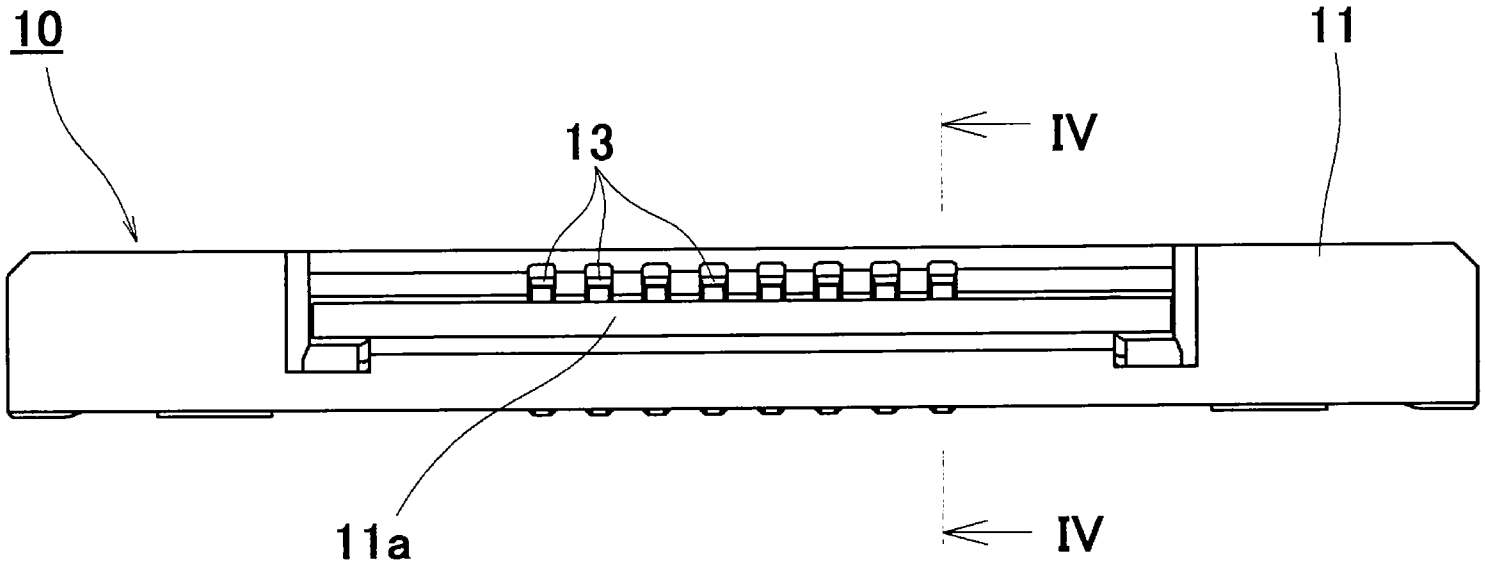
FIG. 3 is a front explanatory view of the electrical connector shown in FIG. 1 and FIG. 2.
Figure 4:
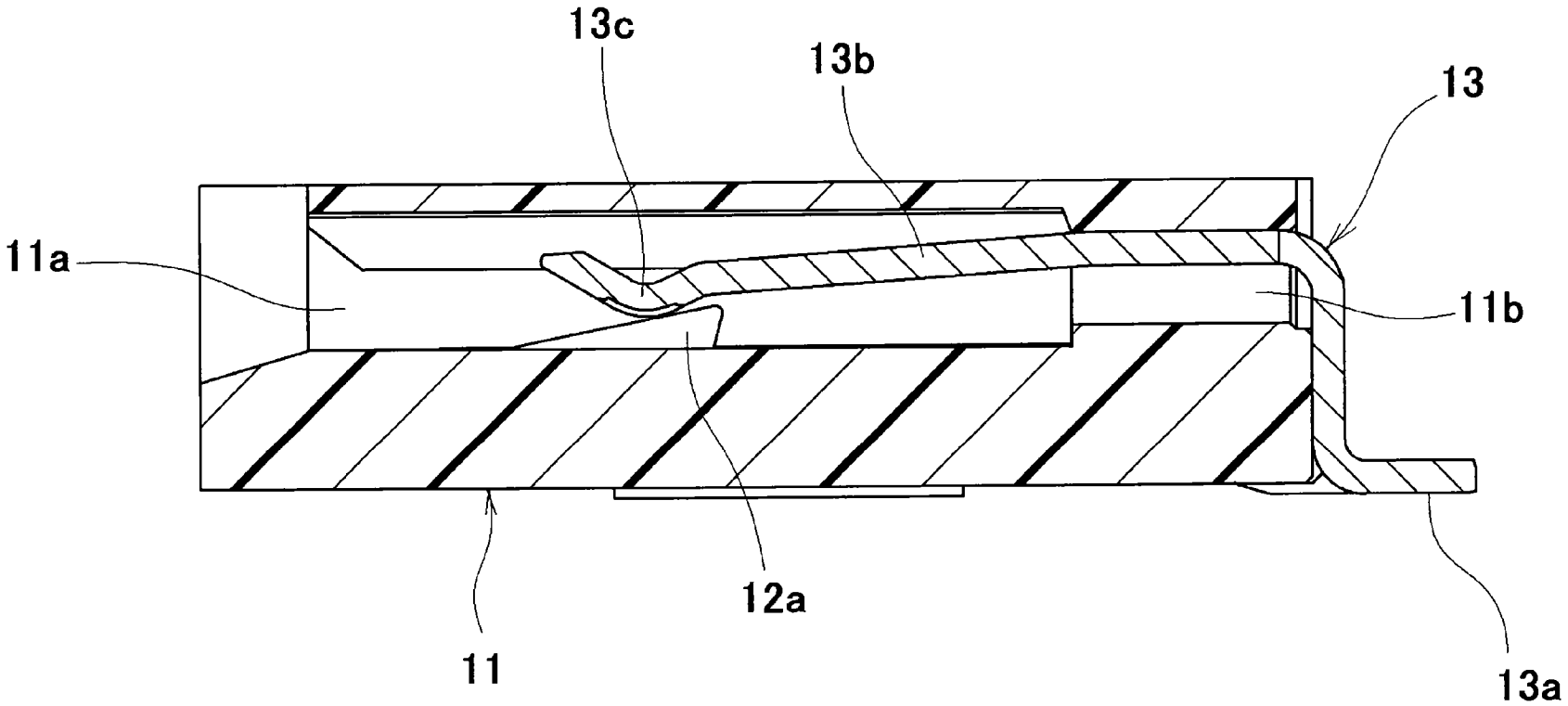
FIG. 4 is a transverse cross-sectional explanatory view taken along a line IV-IV in FIG. 3.

The electrical connector 10 according to the present embodiment is provided with the one-action automatic locking mechanism as described above. As a condition therefor, particularly as shown in FIG. 1, engagement positioning parts Fa and Fa composed of cut-away recessed parts are formed at edge parts in width-direction both sides in the terminal part of the signal transmission medium (for example, FPC or FFC) F. Corresponding to the engagement positioning parts Fa and Fa provided in the signal transmission medium F, the pair of lock members 12 and 12 are provided in the electrical connector 10 side. The insertion state of the signal transmission medium F is configured to be maintained by a latching action (locking action) of the lock members 12 and 12.

[About Lock Members]

As described above, both of the lock members 12 and 12 are disposed at the connector-longitudinal-direction both-end parts of the insulating housing 11. When the signal transmission medium (for example, FPC or FFC) F is inserted into the electrical connector 10, part of each of the lock members 12, more specifically, a later-described latch lock part 12*a* is placed over the surface of the signal transmission medium F; as a result, the lock member 12 becomes a state in which the lock member is elastically displaced downward; and, furthermore, when the latch lock part 12*a* constituting part of the lock member 12 is pushed up toward the interior of the engagement positioning part Fa of the signal transmission medium F, an engaged state (locked state) is obtained.

Each of the lock members 12 of this case is composed of an integral bending structure of a thin-plate metal member particularly as shown in FIG. 5 and FIG. 6 and has a flat-plate-shaped base bottom plate 12*b* placed on the main wiring board (illustration omitted). With respect to the base bottom plate 12*b*, board connecting parts 12*c* solder-joined with the main wiring board, the latch lock part 12*a* which retains the signal transmission medium F, and a lock cancellation operating part 12*e* which cancels the engaged state of the latch lock part 12*a* are integrally provided. At an edge part of the thin-plate metal member constituting the lock member 12 like this, two latching pieces 12*d* and 12*d* are provided at appropriate positions to project from the lock member 12 to the connector front direction. When the latching pieces 12*d* and 12*d* are press-fitted into the insulating housing 11, fixation of the lock member 12 is carried out. A fixing piece 12*f* is provided to project so as to form a step from an edge part of the base bottom plate 12*b* toward the inner side of the connector in the connector longitudinal direction. When the fixing piece 12*f* is inserted into the insulating housing 11, positioning of the lock member 12 in the top-bottom direction is carried out.

The number of the above described board connecting parts 12*c* provided for each lock member 12 is two, and one of the board connecting parts 12*c* is provided so as to project from one of the connector-longitudinal-direction both-end parts toward outside. The other board connecting part 12*c* is provided so as to project from the connector rear end part toward the rear. When the board connecting parts 12*c* are solder-joined with a conductor part formed on the main wiring board (illustration omitted), mounting of the electrical connector 10 is carried out.

From a front-end edge part of the above described base bottom plate 12*b*, in other words, from an edge part in the opposite side of the board connecting part 12*c* provided in the rear end side, a lock arm member 12*g* is integrally extending so as to form a cantilever shape. The lock arm member 12*g* is formed so as to be continued from the board connecting part 12*c* in the rear end side via the base bottom plate 12*b*, and two bent parts 12*g*1 and 12*g*1 each forming an approximately U-shape in lateral face are interposed at the part coupled to the base bottom plate 12*b*. Each of the bent parts 12*g*1 is once projected toward the front from a front edge of the above described base bottom plate 12*b* and then curved so as to be reversed in the upper side of the base bottom plate 12*b*. A main body part of the lock arm member 12*g* continued from the bent parts 12*g*1 is disposed so as to extend obliquely upward toward the connector rear side. The lock arm member 12*g* having such a cantilever structure is configured to be elastically displaceable about the above described bent parts 12*g*1 and the vicinities thereof and be swung in the top-bottom direction in the paper surface of FIG. 7.

At an intermediate position and a free-end position of the above described cantilever-shaped lock arm member 12*g* in the extending direction thereof, the latch lock part 12*a* and the lock cancellation operating part 12*e* are integrally provided. Among them, the latch lock part 12*a* is composed of a hook-shaped member projecting from an edge part of the lock arm member 12*g* and is composed of a plate-like member formed by bending the connector-inner-side edge part included in the lock arm member 12*g* so that it projects upward in an approximately triangular shape. In other words, the latch lock part 12*a* is provided with a tilted guiding side which is extending obliquely downward from an upper-end-side apex part toward the front side.

The latch lock part 12*a* having such a configuration is configured to be pushed up toward the interior of the engagement positioning part Fa by the elastic force of the lock arm member 12*g* and obtain an engaged state when the engagement positioning part Fa provided in the above described signal transmission medium F is disposed at an immediately-above position; and the inserted state of the signal transmission medium F is configured to be retained by the engaging force of the latch lock part 12*a* generated when the mating state is obtained.

On the other hand, the lock cancellation operating part 12*e* is composed of a plate-like member formed by bending the free-end part of the lock arm member 12*g* and having an approximately rectangular shape in a plane, and the lock cancellation operating part 12*e* is continuously provided so as to project to the upper side via a projected step part formed in the rear side of the above described latch lock part 12*a*. When a finger tip of an operator is placed on a flat-surface part of the lock cancellation operating part 12*e* and presses it downward, the latch lock part 12*a* is configured to be elastically displaced downward together with the above described lock arm member 12*g*.

In this case, cut-away parts 11*c* formed so as to cut-away upper surface parts of the insulating housing 11 in approximately rectangular shapes from the rear side are provided at connector-longitudinal-direction both-end parts of the insulating housing 11. The lock cancellation operating part 12*e* in an initial state, in which the operating part is not pushed down, is configured to project upward from the upper surface part of the insulating housing 11 through the cut-away part 11*c* and be visually checked.

Figure 8:
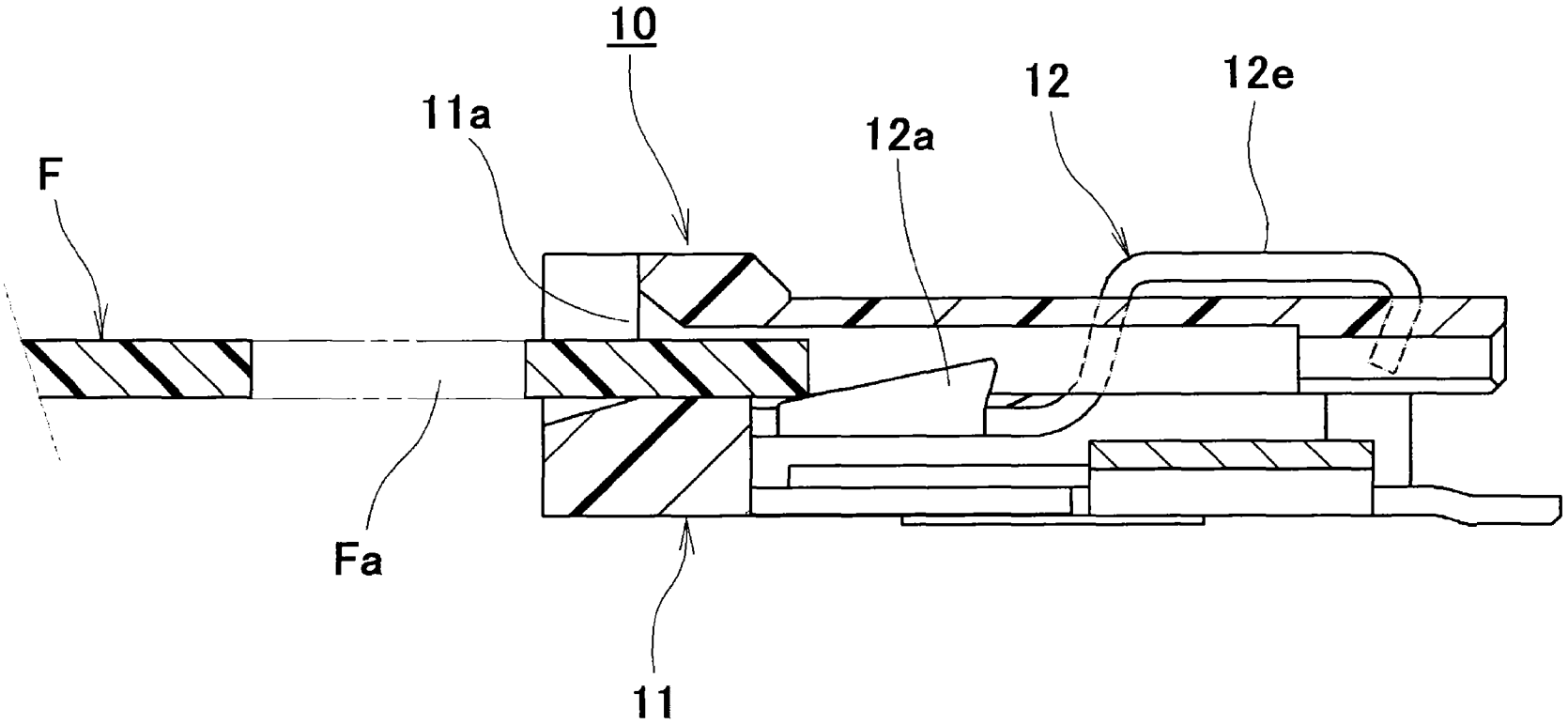
FIG. 8 is a transverse cross-sectional explanatory view of the connector-longitudinal-direction both-end part showing an intermediate state in which the signal transmission medium is being inserted into the connector from the state of FIG. 7.
Figure 9:
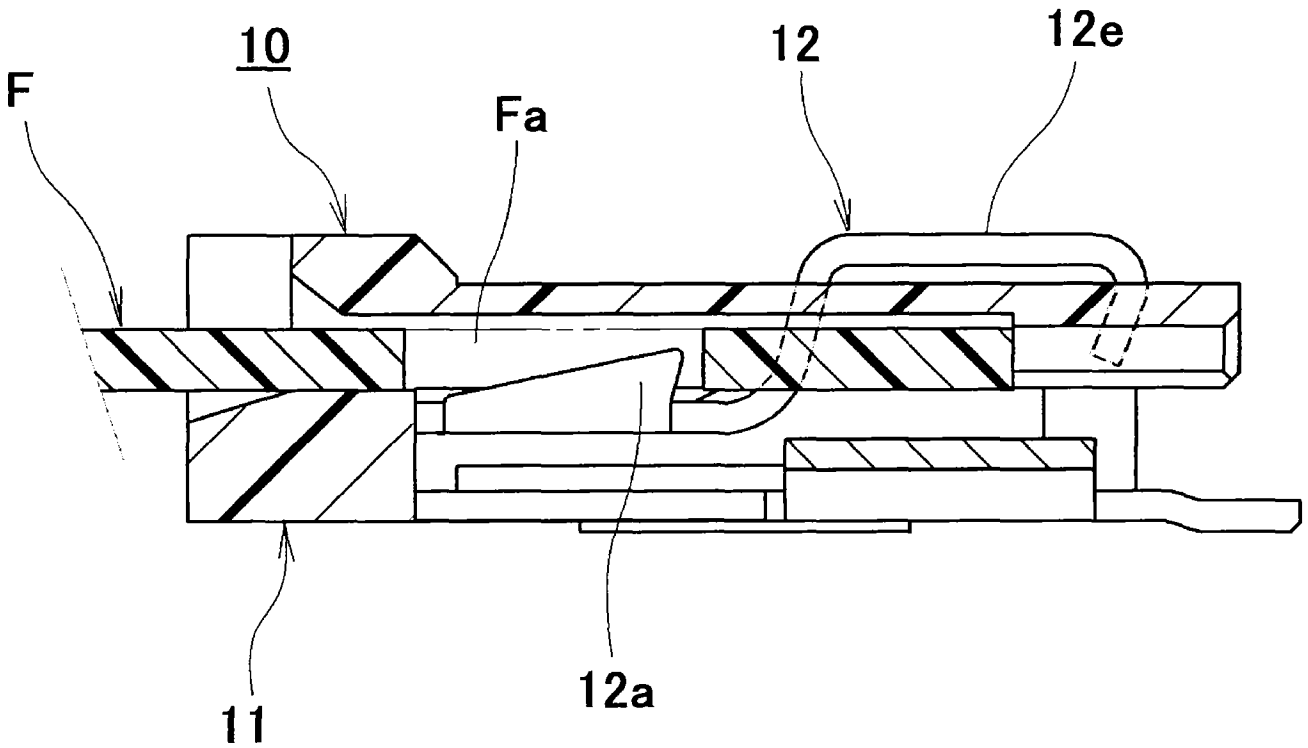
FIG. 9 is a transverse cross-sectional explanatory view showing a state in which the signal transmission medium is latched by a latch lock part, wherein the signal transmission medium has been further inserted from the state shown in FIG. 8, and insertion of the signal transmission medium with respect to the electrical connector has been completed.

The state from insertion to engagement of the signal transmission medium (for example, FPC or FFC) F will be explained in detail. First, as shown in FIG. 7 and FIG. 8, when the signal transmission medium F is inserted into the insulating housing 11 through the medium insertion opening 11*a* of the insulating housing 11, an inserting-side distal-end edge part of the signal transmission medium F abuts the tilted guiding side of the latch lock part 12*a* provided in the lock member 12, and the latch lock part 12*a* is placed over the surface of the signal transmission medium F. As a result, the lock arm member 12*g* of the lock member 12 is elastically displaced about the bent parts 12*g*1 and a swing pivotal point in the vicinity thereof so as to be pushed down to the lower side. When the terminal part of the signal transmission medium F is further pushed in toward the rear side in this state, as shown in FIG. 9, the latch lock part 12*a* is moved by the elastic returning force of the lock arm member 12*g* so as to be pushed up into the engagement positioning part Fa of the signal transmission medium F when the engagement positioning part Fa of the signal transmission medium F is moved to the position immediately above the latch lock part 12*a*. As a result, the latch lock part 12*a* obtains an engaged state with respect to the engagement positioning part Fa of the signal transmission medium F, and the signal transmission medium F is maintained so as not to be removed.

In the intermediate state before the signal transmission medium (for example, FPC or FFC) F is caused to be in the engaged state (locked state) by the lock member 12 in this manner, the lock arm member 12*g* including the above described latch lock part 12*a* is elastically displaced so as to be pushed downward. In this process, the lock cancellation operating part 12*e* is stored from the upper-surface part of the insulating housing 11 into the connector through the cut-away part 11*c* so that the downward elastic displacement of the lock arm member 12*g* can be checked. Then, when the signal transmission medium F becomes the state in which the medium is caused to be in the engaged state (locked state) by the lock member 12, the lock cancellation operating part 12*e*, which has been previously dropped in the insulating housing 11, is configured to project again upward from the upper surface of the insulating housing 11 through the cut-away part 11*c* and be visually checked.

Figure 10:
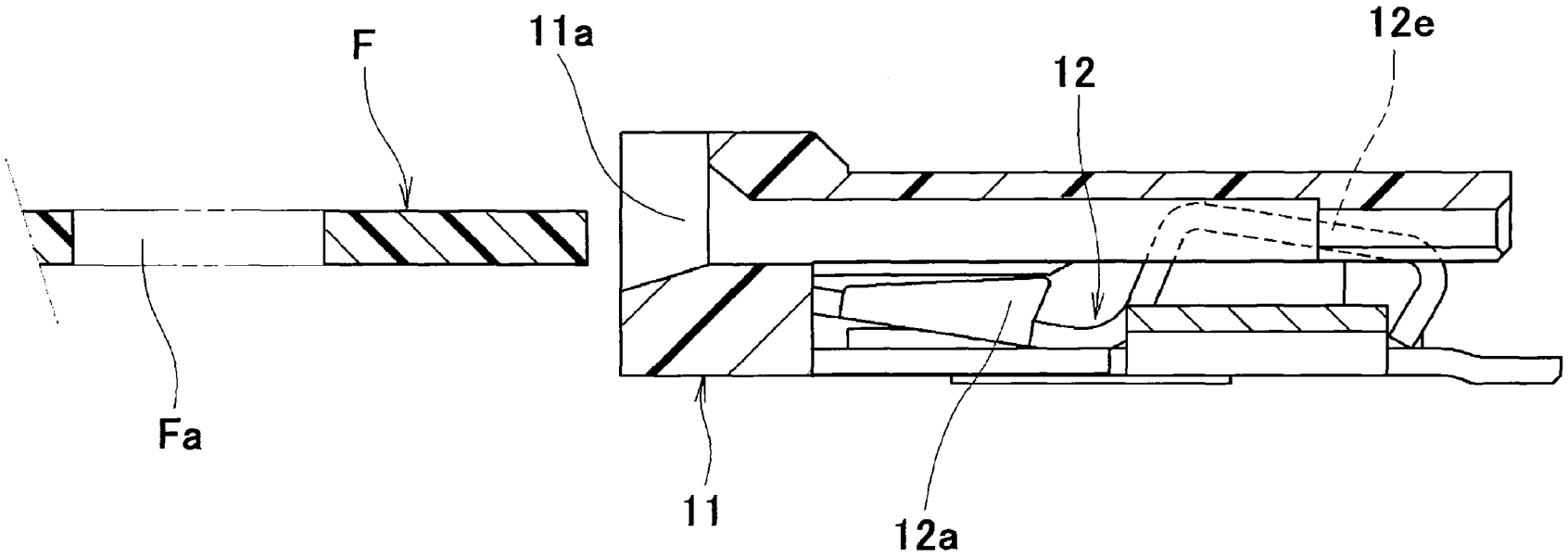
FIG. 10 is a transverse cross-sectional explanatory view showing a state in which a cancelling operation has been carried out from the locked state shown in FIG. 9 and the lock member is push down.
Figure 11:
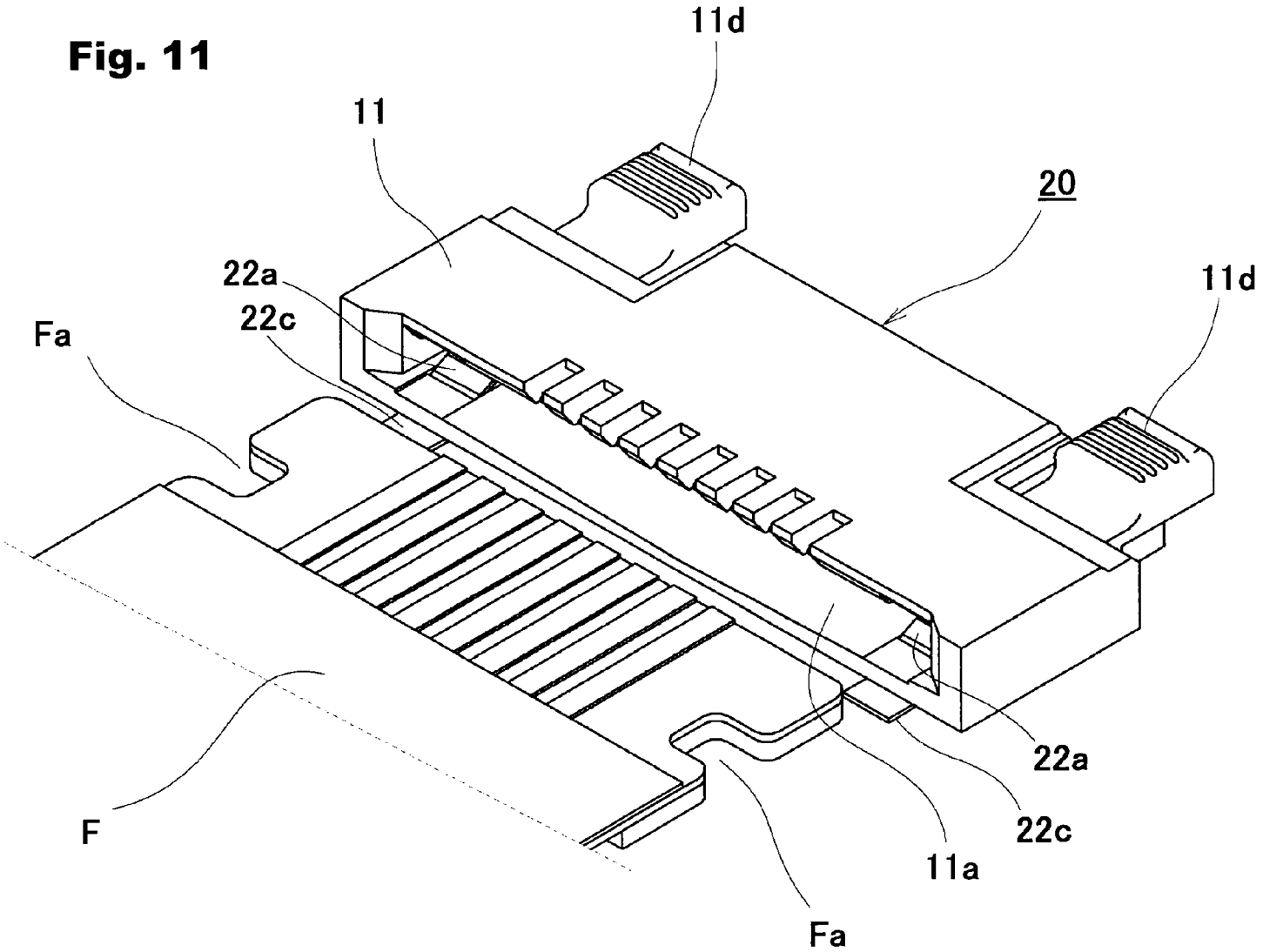
FIG. 11 is an external perspective explanatory view showing an electrical connector according to a second embodiment of the present invention.
Figure 12:
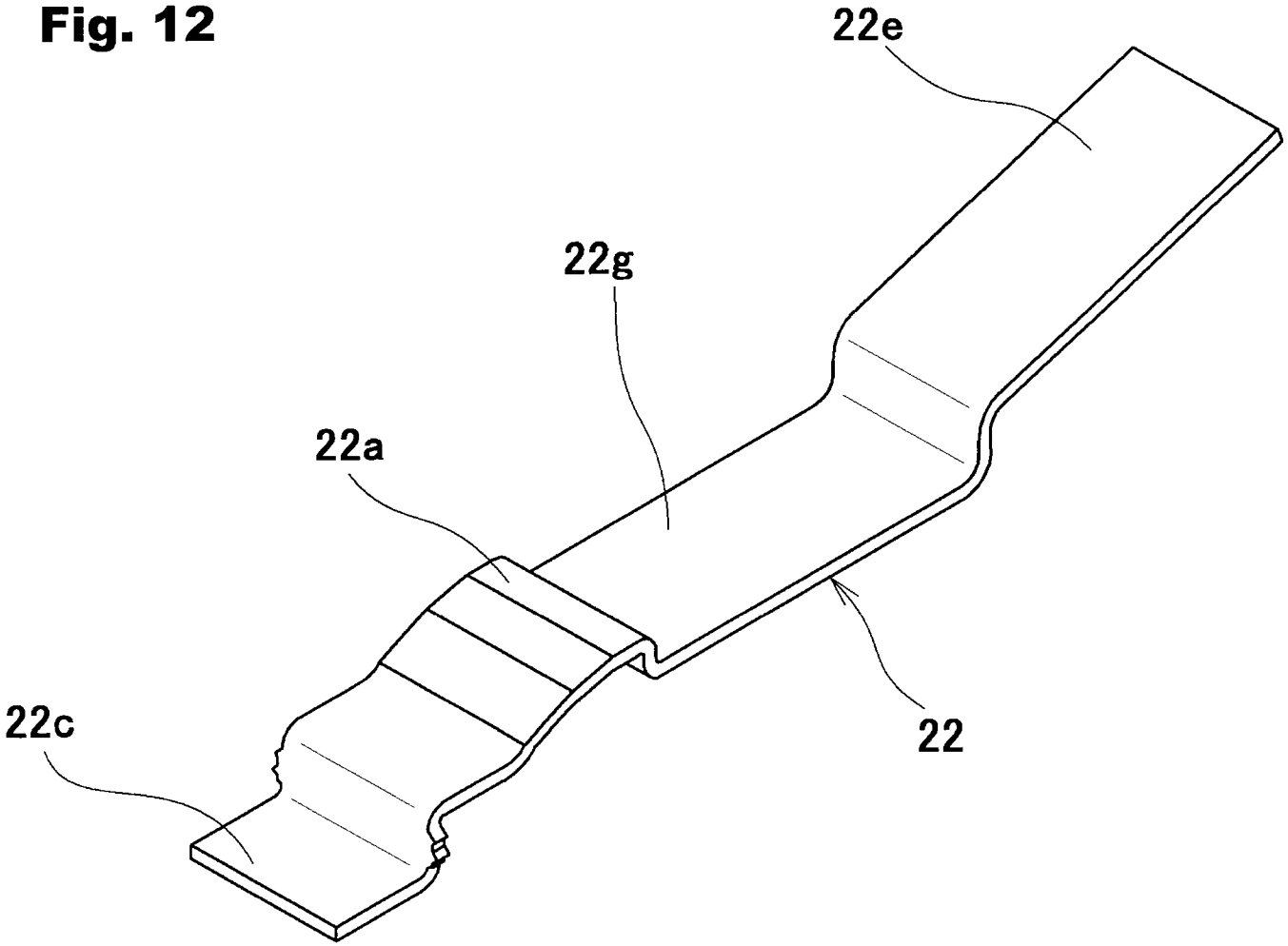
FIG. 12 is an external perspective explanatory view showing, from a planar side, a lock member used in the electrical connector shown in FIG. 11.
Figure 13:
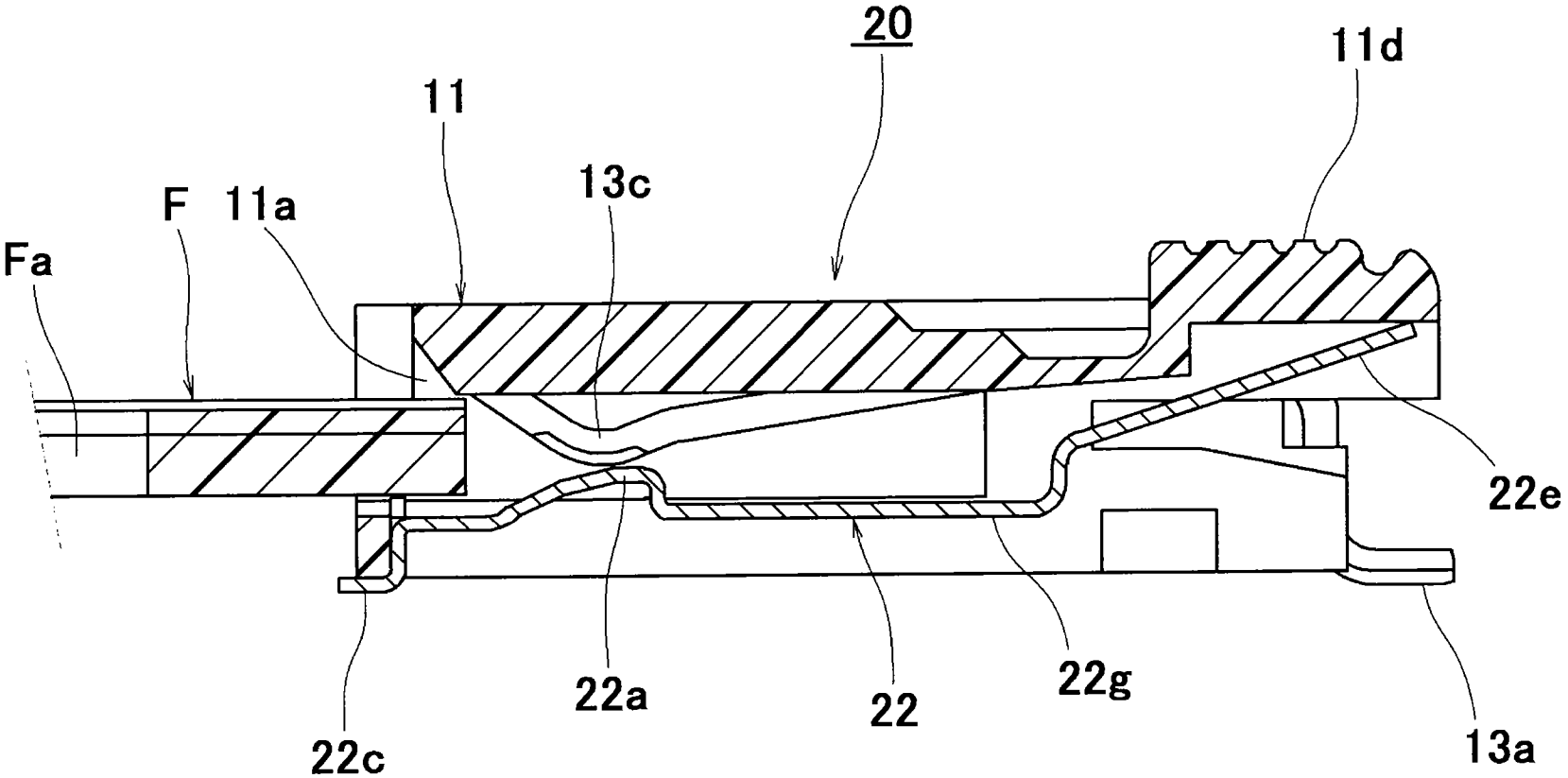
FIG. 13 is a transverse cross-sectional explanatory view of a connector-longitudinal-direction both-end part showing a state in which insertion of a signal transmission medium into the electrical connector shown in FIG. 11 is started.
Figure 14:
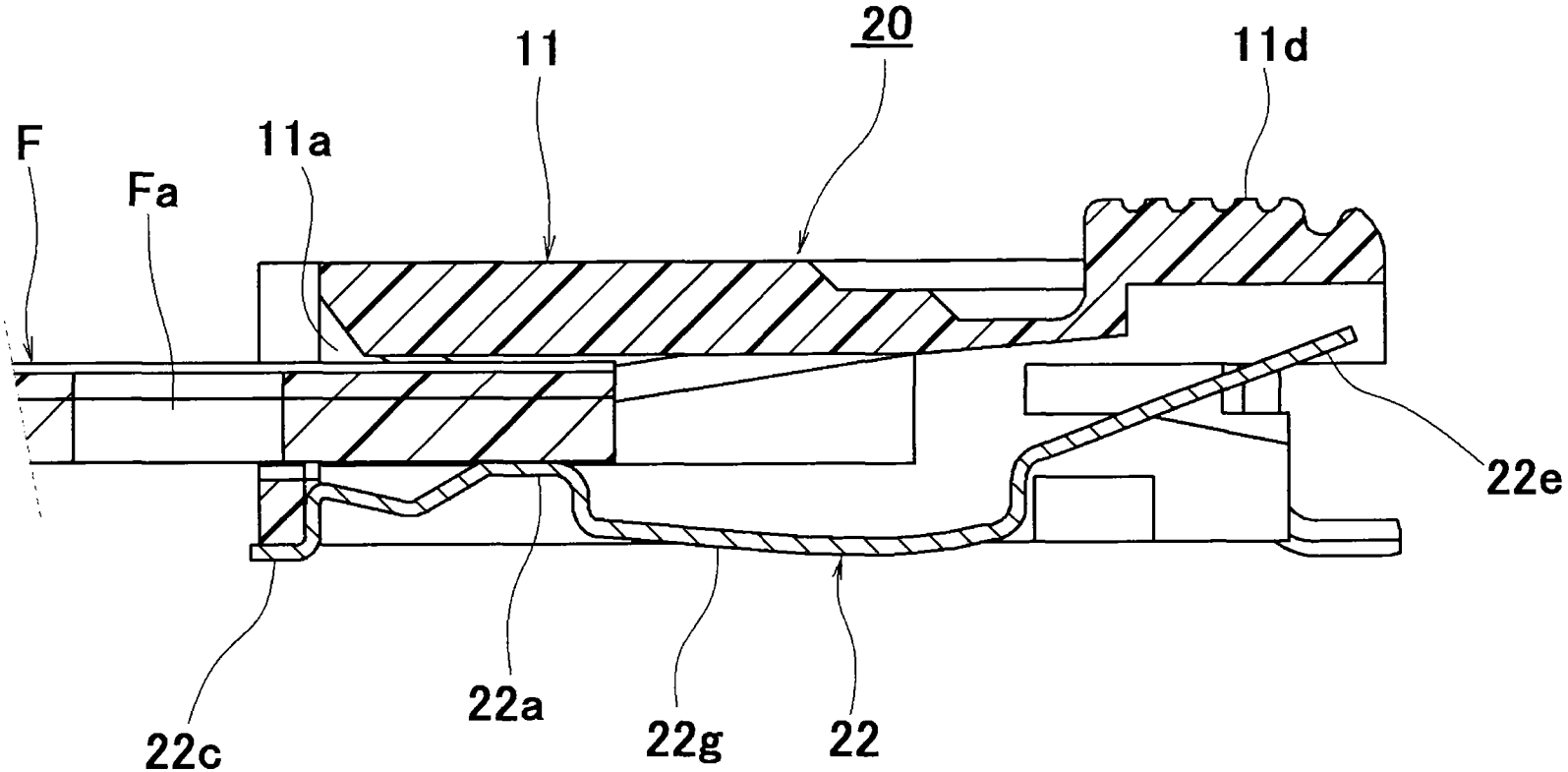
FIG. 14 is a transverse cross-sectional explanatory view of the connector-longitudinal-direction both-end part showing an intermediate state in which the signal transmission medium is being inserted into the connector from the state of FIG. 13.
Figure 15:
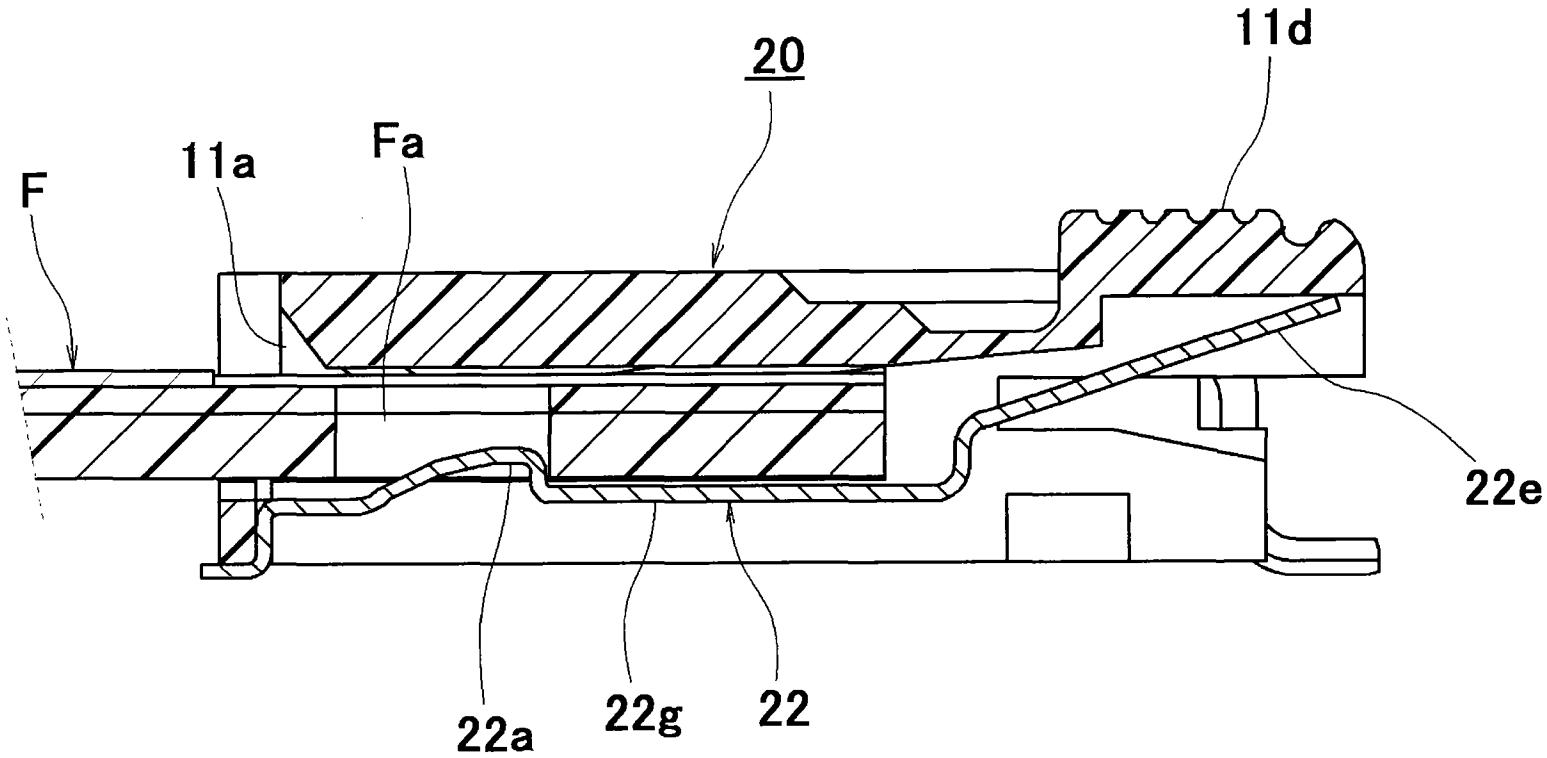
FIG. 15 is a transverse cross-sectional explanatory view showing a state in which the signal transmission medium is latched by a latch lock part, wherein the signal transmission medium has been further inserted from the state shown in FIG. 14, and insertion of the signal transmission medium with respect to the electrical connector has been completed.
Figure 16:
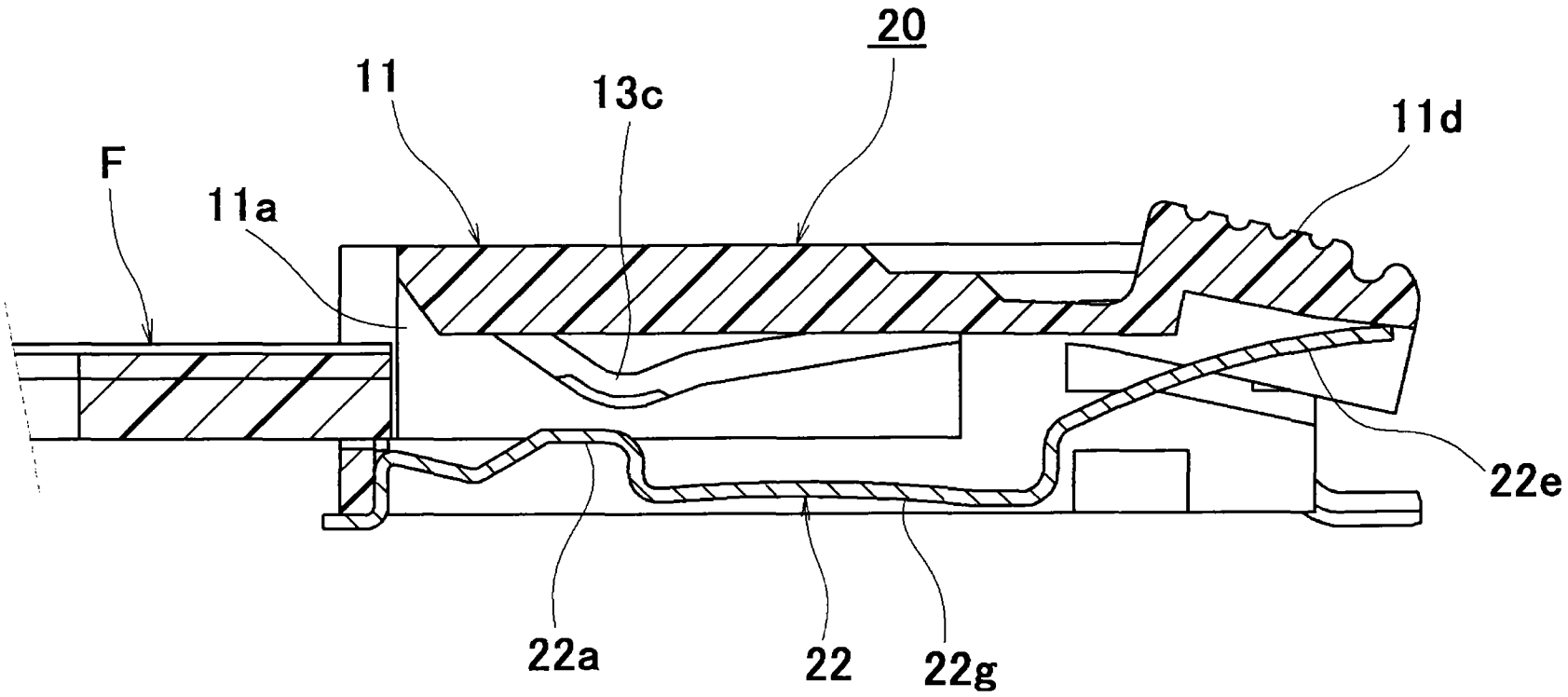
FIG. 16 is a transverse cross-sectional explanatory view showing a state in which a cancelling operation has been carried out from the locked state shown in FIG. 15, and the lock member is pushed down.

On the other hand, when a lock cancelling operation is carried out by pushing down the lock cancellation operating part 12*e* as shown in FIG. 10 in the state in which the latch lock part 12*a* is engaged with the engagement positioning part Fa of the signal transmission medium F to retain the signal transmission medium F in the above described manner, the latch lock part 12*a* is moved downward against the elastic force of the lock arm member 12*g*, the latch lock part 12*a* is detached from the engagement positioning part Fa of the signal transmission medium F, and the engaged state (locked state) of the lock member 12 is cancelled.

According to the lock member 12 according to the present embodiment having such a configuration, the board connecting part 12*c*, the latch lock part 12*a*, and the lock cancellation operating part 12*e* are integrally provided to the lock arm member 12*g*; therefore, the retaining action and the cancelling action of the inserted signal transmission medium (for example, FPC or FFC) F are carried out by the operations of a single member. Therefore, the structure and operation of the lock member 12 including the lock cancellation operating part 12*e* are simplified, and usage durability is also improved.

Particularly, the lock arm member 12*g* in the present embodiment has the bent parts 12*g*1, which are bent-formed so as to be folded back between the board connecting part 12*c* and the latch lock part 12*a*. Therefore, even when the entire electrical connector 10 is downsized, a sufficient length of the lock arm members 12*g* can be ensured in small space, and the operating force of the lock cancellation operating part 12*e* provided at the free-end position can be correspondingly suppressed to be small. Also, when the latch lock part 12*a* is disposed to be close to the bent parts 12*g*1, larger retaining force can be ensured for the latch lock part 12*a*.

Until the retained state is obtained after the signal transmission medium (for example, FPC or FFC) F is inserted, the lock cancellation operating part 12*e* is moved together with the latch lock part 12*a* between a state in which thy are exposed to outside from the cut-away part 11*c* of the insulating housing 11 and an inside buried state. The cut-away part 11*c* from which the lock cancellation operating part 12*e* is exposed to outside is provided in the insulating housing 11. Therefore, if insertion of the signal transmission medium F is not enough, the lock cancellation operating part 12*e* is maintained in the state in which the operating part is buried inside of the cut-away part 11*c* of the insulating housing 11, and whether the insertion operation of the signal transmission medium F is good or not can be easily determined.

[Electrical Connector According to Second Embodiment]

On the other hand, an electrical connector 20 according to a second embodiment of the present invention shown in FIG. 11 to FIG. 16, in which the constituent members which are the same as those of the above described first embodiment are denoted by the same reference numerals, has a structure in which each of lock members 22 is formed by appropriately bending a linearly-extending belt-like member. A lock arm member 22*g* extending to the rear side from a board connecting part 22*c* disposed in a front-end part is extending to a lock cancellation operating part 22*e* disposed in a free-end edge part in the rear side so as to form a belt-like shape having an approximately constant width.

Also, at an intermediate position of the extending direction in the lock arm member 22*g* as described above, a latch lock part 22*a* corresponding to the engagement positioning part Fa of the signal transmission medium (for example, FPC or FFC) F is provided. The latch lock part 22*a* in the present embodiment is disposed so as to extend obliquely upward to the rear side of the above described board connecting part 22*c* via an upper step part and is configured to be bent-formed to form an approximately triangular shape in a lateral face.

As described above in the present embodiment, the board connecting part 22*c* provided in the front-end part of the lock arm member 22*g* is disposed in a connector front-end edge part and is disposed in the opposite side of the board connecting part 13*a* of the electrically-conductive contact 13. In other words, by virtue of such an arrangement relation, the board connecting parts 13*c* provided in the electrically-conductive contacts 13 and board connecting parts 22*c* provided in the lock arm members 22*g* are disposed in mutually-opposed both edge parts of the insulating housing 11. Since both of the board connecting parts 13*a* and 22*c* are disposed in the mutually-opposed both edge parts of the insulating housing 11, the entire electrical connector 10 is fixed in a state that is balanced from both sides, and firm retainability can be obtained with respect to external force caused by, for example, insertion of the signal transmission medium.

Furthermore, the lock cancellation operating part 22*e* in the present embodiment is formed of a plate-like member continuously provided via an upper-side projected step part disposed in a free-end side of the lock arm member 22*g*. Corresponding to the lock cancellation operating part 22*e* as described above, a pair of lock operation cover parts 11*d* and 11*d* are provided at connector-longitudinal-direction both-end parts in rear end parts of the insulating housing 11. At a position immediately above the lock cancellation operating part 22*e* provided in the lock member 22, each of the lock operation cover part 11*d* is extending from the rear end part of the insulating housing 11 to the rear so that an arrangement relation overlapped with the lock cancellation operating part 22*e* is obtained. Each of the lock operation cover parts 11*d* is formed of a comparatively-wide plate-like member, and the comparatively-wide lock operation cover part 11*d* is in an arrangement relation so as to cover, from the upper side, the upper surface of the lock cancellation operating part 22*e* having a narrow plate thickness.

An irregular-shaped anti-slipping part is formed on the upper surface of the lock operation cover part 11*d* as described above. When the lock operation cover part 11*d* is pushed downward, for example, by a finger tip of an operator, the lock cancellation operating part 22*e* of the above described lock member 22 is similarly pushed downward, and, as a result, the lock arm member 22*g* and the latch lock part 22*a* continued to the lock cancellation operating part 22*e* are pushed downward. As a result, the latch lock part 22*a*, which has been previously engaged with the engagement positioning part Fa of the signal transmission medium (for example, FPC or FFC) F is detached downward from the engagement positioning part Fa, and the signal transmission medium F becomes a free state to become a state in which the medium can be removed toward the front side.

Hereinabove, the invention accomplished by the present inventor has been explained in detail based on the embodiments. However, the present invention is not limited to the above described embodiments, and it goes without saying that various modifications can be made within a range not departing from the gist thereof.

For example, in the above described embodiments, flexible printed circuits (FPC) and flexible flat cables (FFC) are employed as the signal transmission media to be fixed to the electrical connector. However, the present invention can be similarly applied also to the case in which other signal transmission media, etc. are used.

Furthermore, the electrically-conductive contacts having a single shape are used in the electrical connector according to the above described embodiments. However, the present invention can be similarly applied also to a structure in which electrically-conductive contacts having mutually different shapes are alternately disposed.

The present invention can be widely applied to various electrical connectors used in various electrical devices.

What is claimed is:

1. An electrical connector configured to be mounted on a wiring board, the wiring board solder-joined with a board connecting part, the electrical connector having a latch lock part engaged with a terminal part of a signal transmission medium inserted in an insulating housing to retain the signal transmission medium in an approximately immobile state, the electrical connector configured so that the engaged state of the latch lock part can be cancelled by operating a lock cancellation operating part; the electrical connector comprising:

a lock member that includes the latch lock part, and a lock arm member integrally extending like a cantilever from the board connecting part and disposed so as to be elastically displaceable; and the latch lock part and the lock cancellation operating part are elastically displaceably provided integrally at an intermediate position and a free-end position in an extending direction of the lock arm member, wherein the lock arm member is bent-formed so as to be reversed and extending between the board connecting part and the latch lock part, and wherein two latching pieces and a fixing piece are provided at an edge part of the lock member for fixation of the lock member, in the manner that [A] the one latching piece projects in parallel with the wiring board from the lock member toward the connector front direction, [B] the other latching piece projects perpendicular to the wiring board from the lock member toward the connector front direction, and [C] the fixing piece projects from the lock member toward the inner side of the connector.

2. The electrical connector according to claim 1, wherein electrically-conductive contact for signal transmission in contact with the terminal part of the signal transmission medium is attached to the insulating housing; and a board connecting part provided in the electrically-conductive contact and the board connecting part provided in the lock arm member are disposed in mutually-opposed both edge parts of the insulating housing.

3. The electrical connector according to claim 1, wherein the lock cancellation operating part is disposed at each of longitudinal-direction both-end parts of the insulating housing; and cut-away parts for exposing the lock cancellation operating parts to outside are provided at the longitudinal-direction both-end parts of the insulating housing.

* * * * *